US005413185A

United States Patent [19]

Kayes

[11] Patent Number: 5,413,185

[45] Date of Patent: May 9, 1995

[54] SOIL DISPLACEMENT HAMMER WITH MOVABLE HEAD

[75] Inventor: Allan G. Kayes, Sittingbourne, United Kingdom

[73] Assignee: Powermole International Ltd., Churt, England

[21] Appl. No.: 142,281

[22] PCT Filed: May 12, 1992

[86] PCT No.: PCT/GB92/00848

§ 371 Date: Feb. 14, 1994

§ 102(e) Date: Feb. 14, 1994

[87] PCT Pub. No.: WO92/20896

PCT Pub. Date: Nov. 26, 1992

[30] Foreign Application Priority Data

May 13, 1991 [GB] United Kingdom ..... 9110294

[51] Int. Cl.[6] ..... F21B 4/14

[52] U.S. Cl. ..... 175/296

[58] Field of Search ..... 175/296–300; 173/78∝80, 90–91

[56] References Cited

U.S. PATENT DOCUMENTS 4,964,477 10/1990 Tupitsyn et al. ..... 175/296
5,193,627 3/1993 Jenne ..... 175/296 X
5,318,140 6/1994 Ekwall et al. ..... 175/298 X

*Primary Examiner*—Michael Powell Buiz
*Attorney, Agent, or Firm*—Darby & Darby

[57] ABSTRACT

The present invention provides a pneumatically operated impact-action self-propelled mechanism for driving holes in the earth, comprising a cylindrical housing assembly (1) with an anvil member (2) located at a forward end thereof; and a pneumatically-operated impact piston (3) reciprocal in the housing to deliver successive impacts to the anvil member (2) and forming with the housing a forward chamber (6) of variable volume. The mechanism includes a head chamber (22) forward of the anvil member (2), a head piston (23) reciprocal in the head chamber (22) and connected at its forward end to the head (24) of the mechanism, and compressed air supply member (29, 30) communicating between the forward chamber (6) and the head chamber (22) to the rear of the head piston (23) so as to cause the head piston to travel forwards.

3 Claims, 2 Drawing Sheets

SOIL DISPLACEMENT HAMMER WITH MOVABLE HEAD

This invention relates to a soil displacement hammer with a movable head.

Soil displacement hammers, commonly referred to as "moles", are pneumatically operated, impact-action self-propelled mechanisms for driving holes in the ground. They can be used to install pipes, cables or conduits in the ground without the necessity for excavating a continuous trench. Moles of this kind are described in GB-A-2 134 152 and GB-A-2 147 035.

Moles have been proposed with moving heads to assist in breaking the soil at the front of the mole. Examples of such moving heads are shown in GB-A-1 392 868 and GB-A-2 111 565. The heads in these moles are powered by the main piston striking the back of the head, the head then travelling forward and being returned by means of a spring. Although it is intended that this reciprocal action continues as the mole progresses through the ground, there are practical difficulties. The force of the surrounding soil tends to hold the head in the forward position, so that the mole once again becomes a fixed head machine. If the spring is made sufficiently strong to return the head against the force of the soil, then it would be far too strong to allow the piston to move the head forward in the first place.

The present invention overcomes the above problems by having the head powered by compressed air, ideally from the same source as the compressed air which powers the main piston.

Thus, the present invention provides a pneumatically operated impact-action self-propelled mechanism for driving holes in the earth, comprising a cylindrical housing assembly with an anvil member located at a forward end thereof; a pneumatically-operated impact piston reciprocal in the housing to deliver successive impacts to the anvil member and forming with the housing a forward chamber of variable volume; characterised by a head chamber forward of the anvil member, a head piston reciprocal in the head chamber and connected at its forward end to the head of the mechanism, and compressed air supply means communicating between the forward chamber and the head chamber to the rear of the head piston so as to cause the head piston to travel forwards.

In a preferred embodiment, the air supply means is a forwardly extending sleeve which is slidably received within a rear space of the head piston. The head piston includes a front interrupted shoulder and a rear continuous shoulder in sliding contact with the internal walls of the forward chamber, and an air port is provided between these two shoulders and communicating between the rear space of the head piston and the head chamber forward of the head piston. When the head piston is in its rearward position, compressed air passes into the rear space and causes the head attached to the piston to move forwards. When the front shoulder of the head piston has moved forward past the outlet of the air supply means, compressed air can escape through the air port into the space in the head chamber in front of the rear shoulder of the head piston. This causes the head piston to move backwards, with the air being exhausted through an exhaust hole communicating between the head chamber and the forward chamber of the main body of the mechanism.

Reference is now made to the accompanying drawings, in which.

Figure 1:
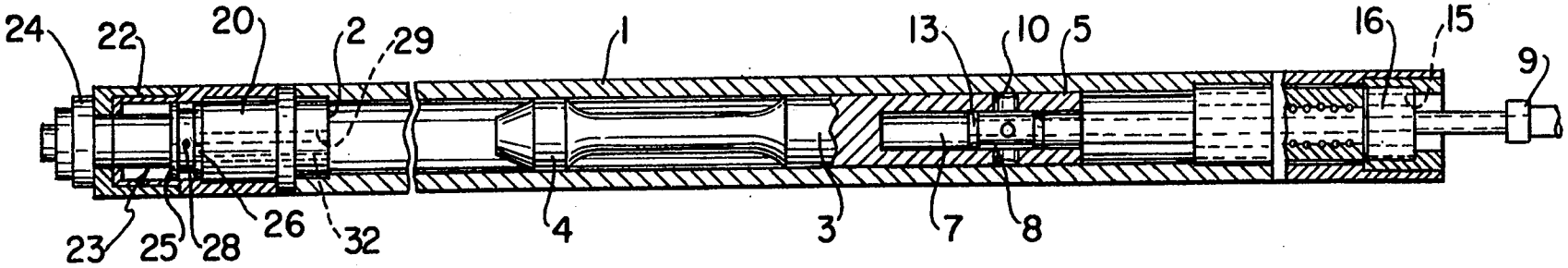
FIG. 1 is a diagrammatic sectional view of a mole according to a preferred embodiment of the invention.
Figure 3:
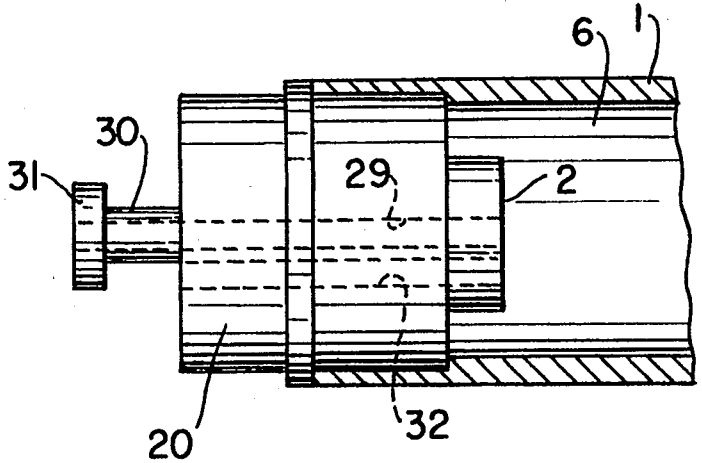
FIG. 3 is a view corresponding to FIG. 2 with the head piston removed for clarity.

Referring to FIG. 1, the main conventional elements of the mole will first be described, these being substantially similar to those of GB-A-2 134 152 and GB-A-2 147 035. The mechanism comprises a cylindrical housing 1 having an anvil 2 located internally at the forward end. An impact piston 3 is reciprocal inside the housing, engaging the internal cylindrical wall of the housing with an interrupted annular shoulder 4 and a continuous annular shoulder 5. The space between the internal wall of the housing and the external surface of the impact piston constitutes a front working chamber 6.

The rear portion of the impact piston 3 has formed therein a cavity 7 which receives a forwardly extending sleeve 8, which is connected to a compressed air supply connector 9. The cavity 7 constitutes the rear working chamber of the mechanism, responsible fox forward displacement of the impact piston 3 as described below. Ports 10 are formed through the cylindrical wall of the impact piston 3 in the area of the rear cavity 7, these ports 4 establishing communication between chambers 6 and 7. At the front end of the sleeve 8 there is provided a front annular ring 13 which is in sliding contact with the internal bore of the cavity 7. The piston 3 reciprocates in the longitudinal direction, but the sleeve 8 does not move longitudinally.

In operation of the mechanism, with the sleeve 8 in the position as shown in FIG. 1, compressed air is fed through the sleeve 8, via its front opening into the rear working chamber 7. This causes the impact piston 3 to be driven forwardly to engage the anvil 2. The resulting impact causes the housing 1 to be driven forwardly.

At a preset point, immediately preceding the point at which the impact piston 3 strikes the anvil (this preset point being defined by the position of the ports 10 in the piston 3 and by the arrangement of the head portion of the sleeve 8), the ports 10 establish communication between the chambers 6 and 7. This occurs when the ports 10 have travelled past the front annular ring 13. The front working chamber 6 then becomes connected with the source of compressed air via the rear working chamber 7, the sleeve 8 and the air supply connector 9.

The rebound of the impact piston 3 after an impact together with the force exerted by the compressed air on the front face of the impact piston, owing to the difference between the working (effective) areas of the impact piston in the chambers 6 and 7 respectively, are responsible for the return stroke of the impact piston after it has delivered the impact upon the anvil 2.

In the course of this return stroke, the ports 10 become closed by the external cylindrical wall of the head portion of the sleeve 8 (i.e. when the ports 10 have moved to the rear of the front annular ring 13). During the rest of the return stroke, the compressed air in the front working chamber 6 is expanding. Towards the end of its return stroke, the motion of the impact piston 3 meets the resistance of the compressed air in the rear working chamber 7, which is continuously connected with the source of compressed air 9. At the end of the return stroke of the impact piston, communication is established between the front working chamber 6 and the ambient atmosphere through exhaust passages 15 in a rear sleeve-supporting member 16. The above described operating cycle then repeats itself.

As the piston 3 moves forwards within the housing 1, the air in the chamber 6 to the front of the piston becomes compressed. This pressure is released in the course of the return stroke of the piston 3. This source of compressed air is used to power the movement of the movable head. To the front of the anvil member 2, there is attached a head assembly support member 20, and this in turn supports a fixed head cylinder 22. A head piston 23 is longitudinally reciprocal in the head cylinder 22. The head 24 of the mole is fixed to the front of the head piston 23. Thus, as the head piston 23 reciprocates, the head 24 itself also reciprocates.

The head piston has a front interrupted shoulder 25 and a rear continuous shoulder 26, the two shoulders being in sliding contact with the internal bore of the head cylinder 22. The rear portion of the head piston 23 has formed therein a cavity 27 with an internal cylindrical bore. At least one port 28 communicates between the cavity 27 and the outside of the head piston 23 between the front shoulder 25 and rear shoulder 26.

An air passage 29 is formed through the anvil 2 and support 20 and continues forward through a forwardly extending sleeve 30 which extends into the cavity 27. The sleeve 30 is open at its front end and is provided there with an annular ring 31 in sliding contact with the internal cylindrical bore of the cavity 27. An air exhaust passage 32 generally in line with the air supply passage 29 is also formed through the anvil 2 and support member 20 and communicates between the chamber inside the front head cylinder 22 and the front chamber 6 of the main body of the mole.

Figure 2:
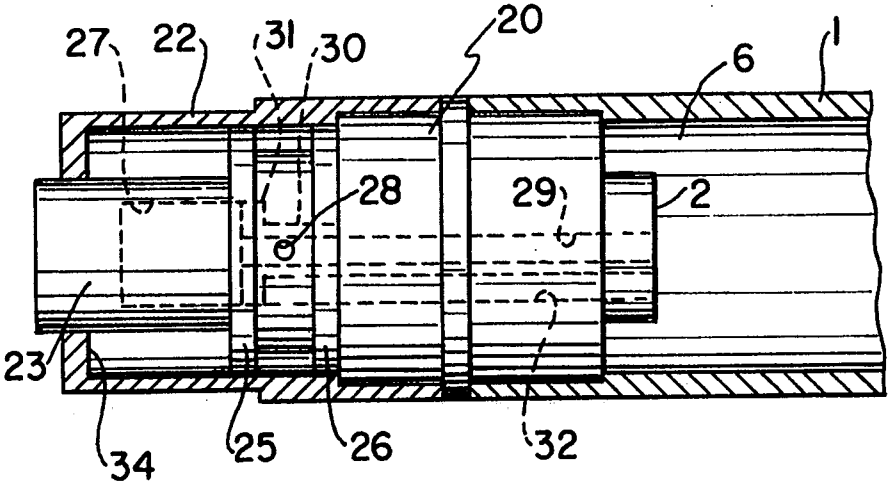
FIG. 2 is a detailed view of elements in the front section of the mole with the head piston in the rearward position.

In the rearward position of the head piston, shown in FIG. 2, the front of the sleeve 30 is forward of the port 28. Compressed air thus passes from the chamber 6, through the air supply passage 29, into the cavity 27 and causes forward movement of the head piston 23 and thus the head 24 itself. The head piston 23 moves forward until the port 28 is in front of the forward end of the sleeve 30. Air then passes from the sleeve 30 through the port 28 and around the interrupted shoulder 25 into the internal cavity of the head cylinder 22. This air presses against the front surface of the shoulder 25 and causes rearward movement of the head piston 23, and hence the head 24. Air within the cavity of the head cylinder 22 is exhausted through the exhaust passage back to the chamber 6. The cycle then repeats itself.

Figure 4:
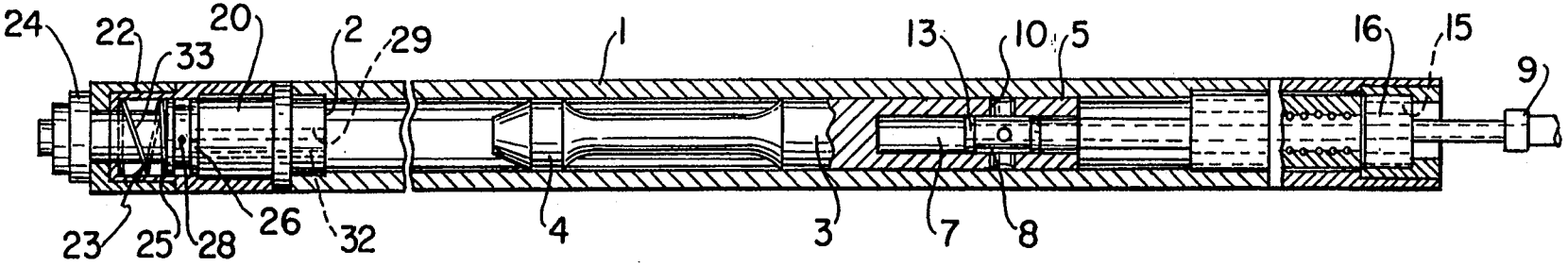
FIG. 4 is a view corresponding to FIG. 1 of a modification in which the return of the head is assisted by a spring.
Figure 5:
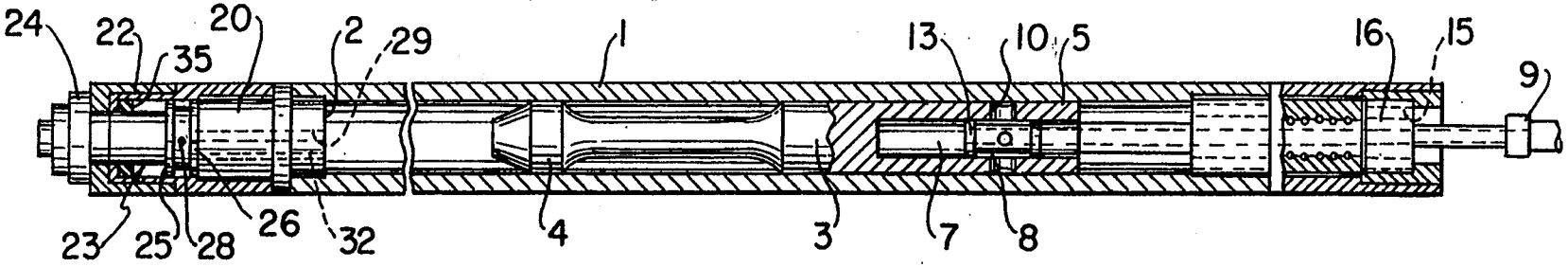
FIG. 5 is a view of a further modification in which the return of the head is assisted by a rubber bush.

The forward and rearward movement of the head piston can be powered entirely by compressed air as described above. However, the rearward movement of the head piston can be assisted by resilient means, such as a spring or rubber bush. Such a spring is shown at 33 in FIG. 4 and is in the forward part of the head cylinder bore between a front flange 34 and the front surface of the front shoulder 25 of the piston. Alternatively, an extension spring may be placed between the rear surface of the rear shoulder 26 and the front of the support member 29. A rubber bush is shown at 35 in FIG. 5 and is positioned just to the rear of the front flange 34 of the head cylinder.

The air supply passage 29 and the air exhaust passage can be provided with one or more valves, such as flap valves or ball valves, to enable air to pass solely in the desired direction. However, the design of the apparatus is such that valves of this kind are not essential, and it is generally preferable not to include such valves as they require extra maintenance.

I claim:

1. A pneumatically operated impact-action self-propelled mechanism for driving holes in the earth, comprising a cylindrical housing assembly (1) with an anvil member (2) located at a forward end thereof; a pneumatically-operated impact piston (3) reciprocal in the housing to deliver successive impacts to the anvil member (2) and forming with the housing a forward chamber (6) of variable volume; characterised by a head chamber (22) forward of the anvil member (2), a head piston (23) reciprocal in the head chamber (22) and connected at its forward end to the head (24) of the mechanism, and compressed air supply means (29,30) communicating between the forward chamber (6) and the head chamber (22) to the rear of the head piston (23) so as to cause the head piston to travel forwards.

2. A mechanism according to claim 1, in which the air supply means is a forwardly extending sleeve (30) which is slidably received within a rear space (27) of the head piston (23); the head piston (23) includes a front interrupted shoulder (25) and a rear continuous shoulder (26) in sliding contact with the internal walls of the forward chamber (22); and an air port (28) is provided between these two shoulders and communicating between the rear space (27) of the head piston and the head chamber (22) forward of the head piston; whereby, when the head piston (23) is in its rearward position, compressed air passes into the rear space (27) and causes the head (24) attached to the piston to move forwards; when the front shoulder (25) of the head piston has moved forward past the outlet of the air supply means (30), compressed air can escape through the air port (28) into the space in the head chamber (22) in front of the rear shoulder (26) of the head piston, causing the head piston (23) to move backwards, with the air being exhausted through an exhaust hole (32) communicating between the head chamber (22) and the forward chamber (6) of the main body of the mechanism.

3. A mechanism according to claim 1, also comprising resilient means (33,35) to assist rearward movement of the head piston (23).

* * * * *